United States Patent [19]

McGee

[11] 4,335,763

[45] Jun. 22, 1982

[54] VENEER LATHE CHARGER HAVING IMPROVED POSITIONING FOR CHARGER SPINDLES

[75] Inventor: Arthur L. McGee, Lake Oswego, Oreg.

[73] Assignee: The Coe Manufacturing Co., Painesville, Ohio

[21] Appl. No.: 154,201

[22] Filed: May 29, 1980

[51] Int. Cl.[3] ..... B27L 5/02

[52] U.S. Cl. ..... 144/209 A; 82/25; 82/45; 250/560; 356/384

[58] Field of Search ..... 144/204 R, 209 A; 82/2.5, 45; 356/356, 387, 384, 398, 386; 250/560, 552; 364/556, 564

[56] References Cited

U.S. PATENT DOCUMENTS

| | | | |
|---|---|---|---|
| 3,037,538 | 6/1962 | Graham | 144/209 A |
| 3,392,765 | 7/1968 | Brookhyser et al. | 144/209 R |
| 3,752,201 | 8/1973 | Heth | 144/209 A |
| 3,852,579 | 12/1974 | Sohn et al. | 144/209 A X |
| 4,197,888 | 4/1980 | McGee et al. | 144/209 A |
| 4,246,940 | 1/1981 | Edwards et al. | 144/209 A |

*Primary Examiner*—W. D. Bray

*Attorney, Agent, or Firm*—Klarquist, Sparkman, Campbell, Leigh, Whinston & Dellett

[57] ABSTRACT

A veneer lathe charger apparatus is described having an improved charger spindle positioning system which is less vulnerable to damage, is of simpler construction and is of faster operation. The charger spindle positioning system includes spindle support and adjustment means for moving the spindles both horizontally and vertically by linear movement in one direction of linear positioning means at the opposite ends of the log. The linear positioning means are located above the log so as not to be damaged by a falling log. Each linear positioning means includes a pair of cylinders whose piston rods are pivotally attached to a spindle support plate on opposite sides of the spindle. A log support and centering means receives logs at a pick up position and transports such logs to a scan position after rough centering and clamping the logs with their longitudinal axis in such a scan position. The charger spindles engage the log in the scan position and rotate the log while it is scanned with a light beam to determine the optimum yield axis of the log for the greatest production of wood veneer. The charger spindles are then moved automatically by the linear positioners to move the log from the scan position until its optimum axis is aligned with a transfer position located at a predetermined position relative to the lathe axis. Transfer arms engage the log to move the log from the transfer position to the lathe where the optimum axis of the log is in alignment with the lathe spindle axis.

16 Claims, 6 Drawing Figures

70
67
68
84
82
72"
78
76'
72'
88
80
74'
86
54
74
76
90
18'
18"
72
64
92
24"
24'
22
24
18

VENEER LATHE CHARGER HAVING IMPROVED POSITIONING FOR CHARGER SPINDLES

BACKGROUND OF THE INVENTION

The present invention relates generally to log processing apparatus and in particular to veneer lathe charger apparatus which scans the log with a light beam to determine its optimum axis for greatest veneer production and positions such log so that such optimum axis is moved into alignment with the lathe axis.

One such lathe charger apparatus is shown in my earlier U.S. Pat. No. 4,197,888 by A. L. McGee et al issued Apr. 15, 1980. In this patented lathe charger apparatus the optimum axis of a log is determined by directing a light beam past the side of the log through the space between such log and a reference edge to project an image of such space onto a photoelectric detector while the log is rotated to thereby determine the optimum axis of such log. While a similar scanning technique is employed in the preferred embodiment of the present invention, it will be appreciated that any light beam scanning technique can be employed for determining the optimum axis of the log including light reflection from the side of the log, as shown in U.S. Pat. No. 3,852,579 of Sohn et al.

It has been found that prior lathe chargers employing separate horizontal positioning means and vertical positioning means for moving the charger spindles in horizontal and vertical directions, are complicated and expensive. In addition, in the past such horizontal and vertical positioners have been located beneath the log so that they are damaged when a log is accidentially dropped. Also, such prior lathe chargers scan the log to determine its optimum axis at the same position where such log is engaged by transfer arms and moved to the lathe axis. This necessitates reclamping of the log by the clamp arms used for rough centering, to hold it in position after scanning while the charger spindles are disengaged and the transfer arms are moved to engage the log. The log support and centering means in the present lathe charger returns from the scan position to the pick up position and does not reclamp the log in the transfer position. As a result the log is only held by the charger spindles when it is engaged by the transfer arms in the transfer position. No reclamping of the log is necessary because in the scanning position the charger spindles are spaced sufficiently below the transfer position to provide clearance for the transfer means as it moves back from the lathe axis positon to the transfer position. This enables four legs to be simultaneously acted upon by the lathe charger apparatus of the present invention and greatly increases the speed of operation of such charger. This reduces the speed of operation of the charger apparatus because reclamping prevents the clamp members from being used to support and roughly center the next log prior to scanning. These problems are overcome by the charger apparatus of the present invention.

SUMMARY OF INVENTION

It is therefore one object of the present invention to provide an improved log processing apparatus of simpler construction including a charger spindle support and adjustment means which is less likely to be damaged by dropped logs.

Another object of the invention is to provide such an apparatus in which the charger spindles are moved vertically and horizontally by a linear positioning means which moves in one direction and thereby forms an improved spindle support and adjustment means.

A further object of the present invention is to provide a veneer lathe charger apparatus with such an improved spindle support and adjustment means.

An additional object of the invention is to provide such a lathe charger apparatus which is of faster operation and requires no reclamping of the log after scanning when such log is engaged by the transfer arms and the charger spindles are disengaged.

Still another object of the present invention is to provide such a charger apparatus in which the log is moved from a scan position where its optimum yield axis is determined to a transfer position which is spaced sufficiently from such scan position that the transfer means will clear the charger spindles when such transfer means is moved from the lathe axis back to the transfer position.

A still further object of the present invention is to provide such a lathe charger apparatus of fast operation in which a log support and centering means is employed for receiving a log at a pick-up position spaced from the scanning position and rough centering the axis of the log before it reaches such scanning position.

Still another object of the present invention is to provide such a charger apparatus in which the optimum yield axis of the log is determined by light beam scanning and the log is moved from the scan position until such optimum axis is in alignment with a transfer position which is located at a predetermined position with respect to the lathe spindle axis in a simple, inexpensive and accurate manner.

DRAWINGS

Other objects and advantages of the present invention will be apparent from the following detailed description of a preferred embodiment thereof and from the attached drawings of which:

DESCRIPTION OF PREFERRED EMBODIMENT

Figure 1:
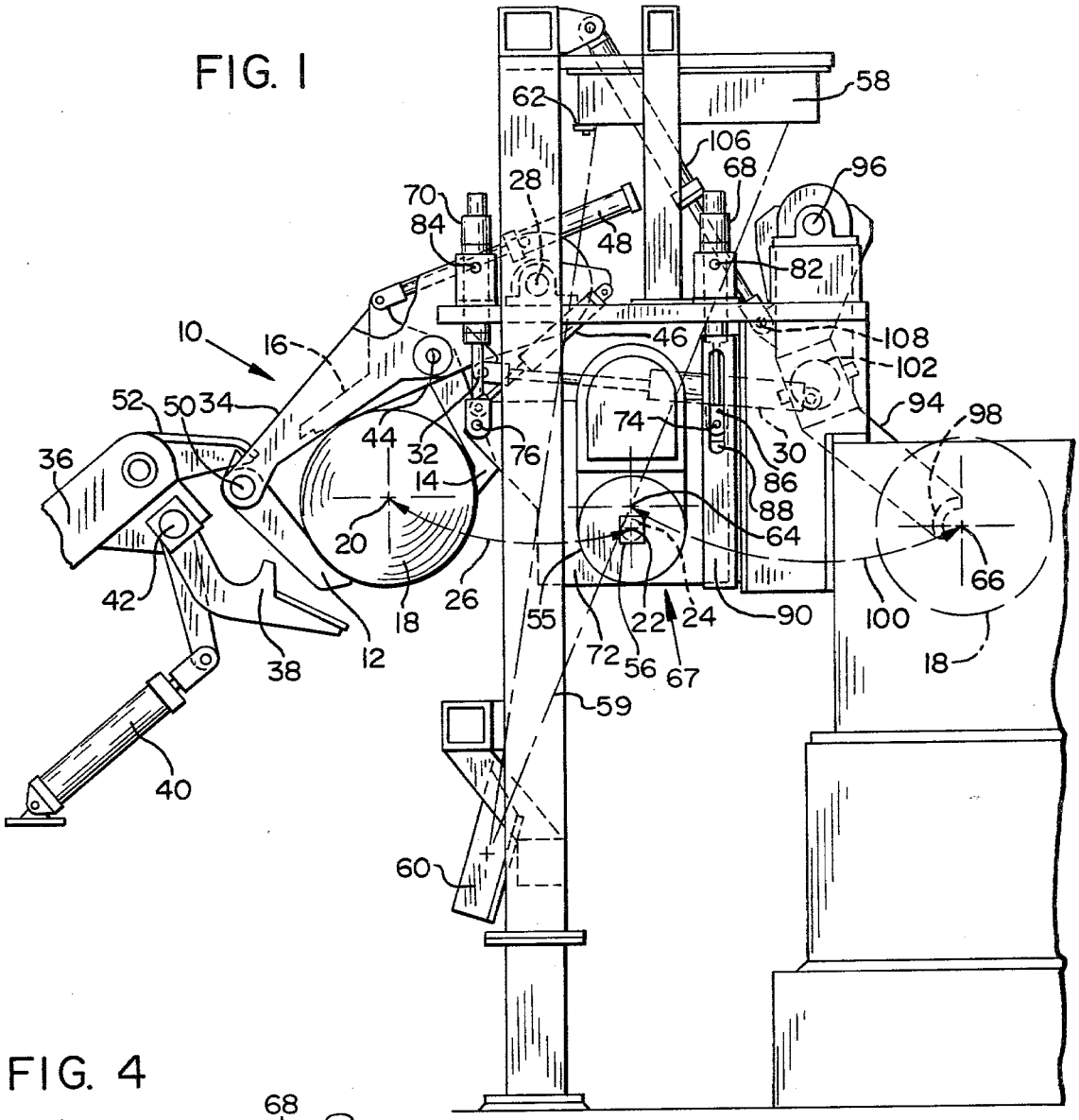
FIG. 1 is a side elevational view of a lathe charger apparatus in accordance with the present invention with parts removed for clarity.
Figure 4:
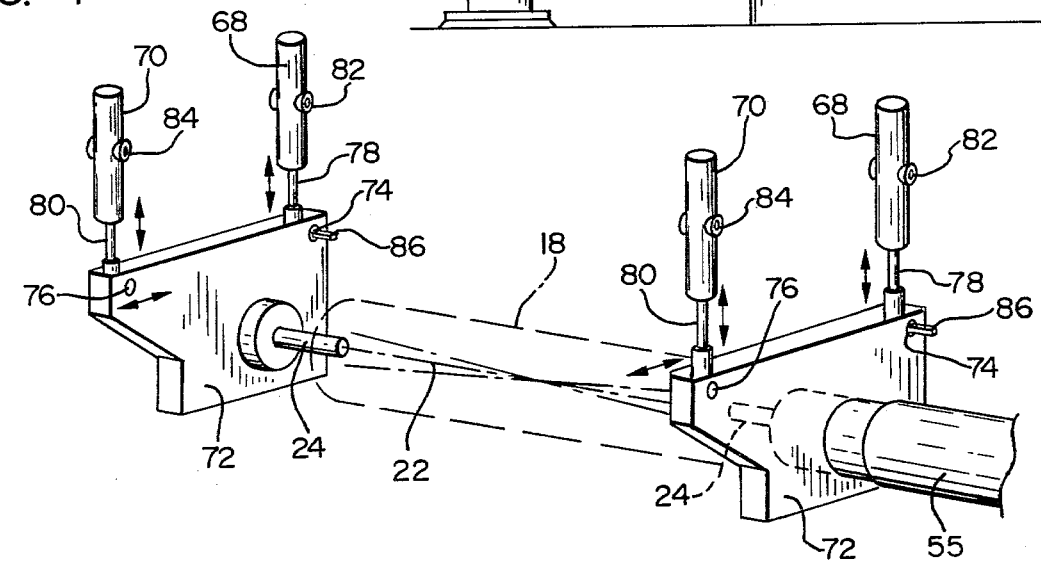
FIG. 4 is a partially diagrammatic view showing the charger spindle support and adjustment means used at both ends of a log in the apparatus of FIGS. 1 to 3.
Figure 2:
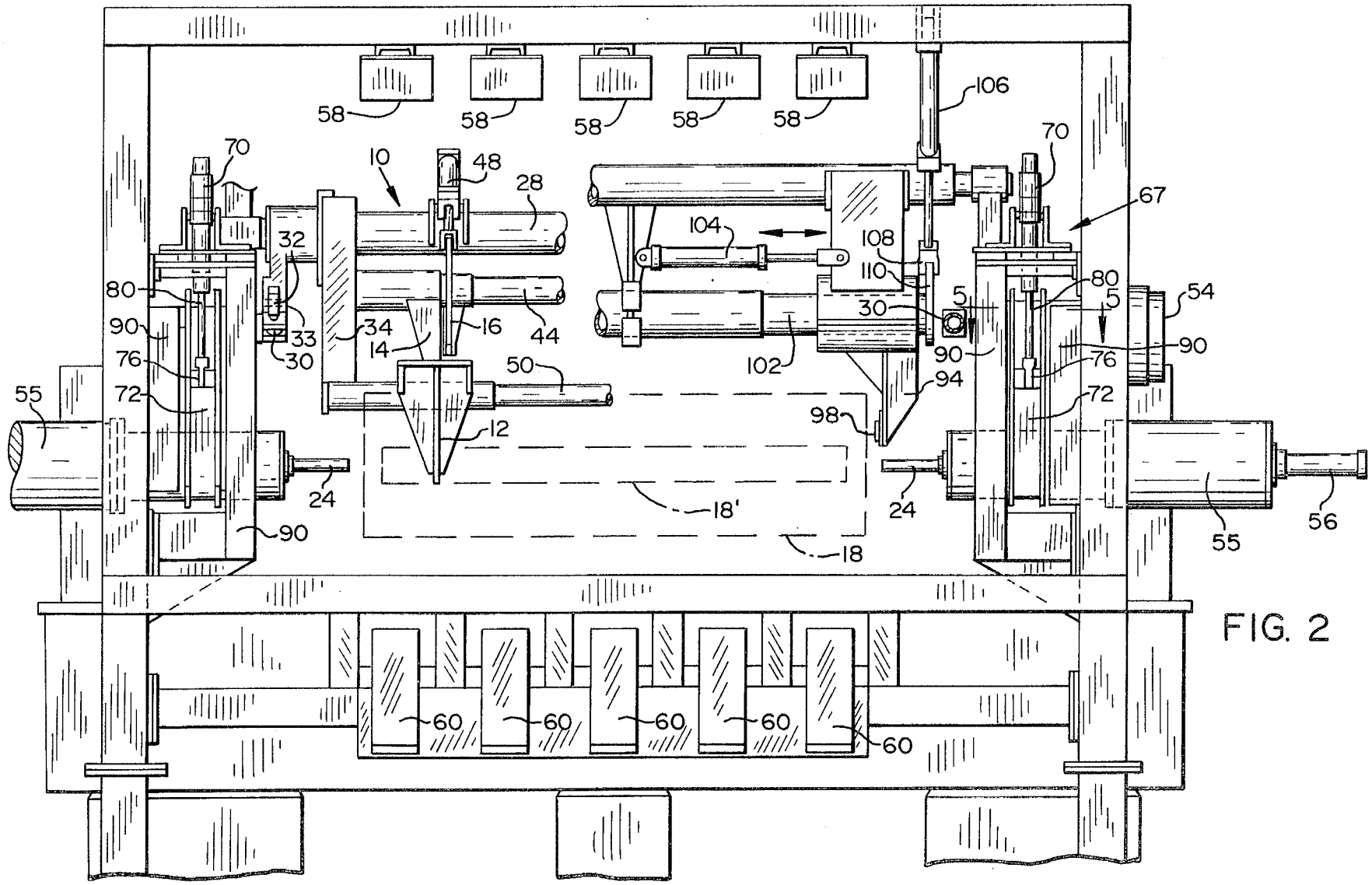
FIG. 2 is a front elevational view of the lathe charger apparatus of FIG. 1 with parts broken away for clarity.

As shown in FIGS. 1 and 2 one embodiment of the lathe charger apparatus of the present invention includes a pair of log support and centering mechanisms 10 adjacent the opposite ends of a log 18 each including three pivoted clamp arms 12, 14 and 16 supported on a pivoted support member 34. The clamp arms center and clamp the log 18 so that the longitudinal axis of the log is roughly centered at a pick up position 20. The log is moved by such clamp arms from the pick up position to a scan position axis 22 where such rough center axis is in alignment with the axis of a pair of charger spindles 24. This movement from the pick up position to the scan position is indicated by the double headed arrow 26 and is accomplished by pivoting the entire log support and centering mechanism 10 about a support shaft 28. The pivoting of the log support and centering mechanism 10 is accomplished by means of an actuator cylinder 30 whose piston rod is connected at pivot 32 to a lever arm 33 which rotates support shaft 28 to cause the support member 34 to pivot about shaft 28. This log support and centering mechanism may be of the type described in U.S. Pat. No. 3,392,765 of D. B. Brookhyser et al issued July 16, 1968. Therefore, the operation of such log support and centering mechanism will not be described in detail. It should be noted that rough centering of the log 18 may take place at the pick-up position 20 or while it is being transmitted from the pick-up position 20 to the scan position 22.

Logs are fed to the pick-up position 20 by a conveyor 36 which is provided with lug type conveyor chains. Each log is transmitted from the top of the conveyor onto a pair of spaced log lowering arms 38 which absorb the force of the log as it rolls off the conveyor down a ramp 52 onto such arm. The arm 38 then gently lowers the log onto the lower clamp arm 12 before continuing downward into the rest position shown in FIG. 1. The log lowering arms 38 are operated by hydraulic pistons 40 which cause such arm to pivot about a support shaft 42.

The upper clamp arms 14 and 16 pivot about a common support shaft 44 when they are actuated by cylinders 46 and 48 respectively,. The support shaft 44 is attached between the main support members 34 for movement therewith. The clamp arm 12 is also pivotally connected to a shaft 50 attached to the main support members. The lower clamp arm 12 is pivoted into the position shown in FIG. 1 by a fixed link 51 connected between clamp arms 12 and 14 and by a slip link 53 connected between clamp arms 12 and 16, such links being shown in FIG. 6.

After the log 18 is centered and moved to the scan position 22, such log is rotated by a pair of charger spindles 24 which engage the opposite ends of such log and are driven by motors 54 which are coupled by drive chains to drive sprockets within housings 55. The charger spindles 24 are extended and retracted by a means of hydraulic cylinders 56 connected to the shaft of each such spindle. The motors 54 may be electrical step motors which rotate the log precisely through complete revolution while such log is being scanned by a light beam 59 to determine the optimum yield axis of a log for greatest veneer production, as described in my earlier U.S. Pat. No. 4,197,888. A plurality of light sources 58 are mounted on the frame at positions above and spaced longitudinally along the log to direct a light beam 59 down such log to a corresponding number of longitudinally spaced photoelectrical detectors 60 which may be of the type having a linear array of photosensitive diodes as described in my earlier patent. A reference edge member 62 is mounted on the housing of each light source 58 to limit one edge of the light beam which is transmitted to the light detector 60. The other edge of such transmitted light beam is limited by the side of the log 18 being tested at the scan position 22. Thus, the width of the transmitted light beam received by the detectors 60 is proportional to the distance between the reference edge 62 and the side surface of the log.

The output signals of the light detectors 60 are transmitted to a computer for each rotational position of the log during scanning. The computer calculates the radial distance for the scanning axis 22 to the measured surface of the log as shown in FIG. 8 of my earlier U.S. Pat. No. 4,197,888. As a result of this light beam scanning, the optimum yield axis of the log can be determined and the log is then moved from the scanning position 22 until such optimum yield axis is at a transfer position axis 64 which is located at a predetermined position relative to the lathe spindle axis 66. It should be noted that while there are two log support and centering mechanisms 10 positioned adjacent the opposite ends of the log but for purpose of clarity only one is shown in FIG. 2. Thus, the log support and centering mechanism on the right end of the log has been removed to show the transfer arm and associated actuating cylinder for moving the log from the transfer position 64 to the lathe spindle axis 66. Similarly, while there are two transfer arms at the opposite ends of the log, only one is shown and the left transfer arm has been removed for purposes of clarity to show the log support and centering mechanism 10.

Figure 3:
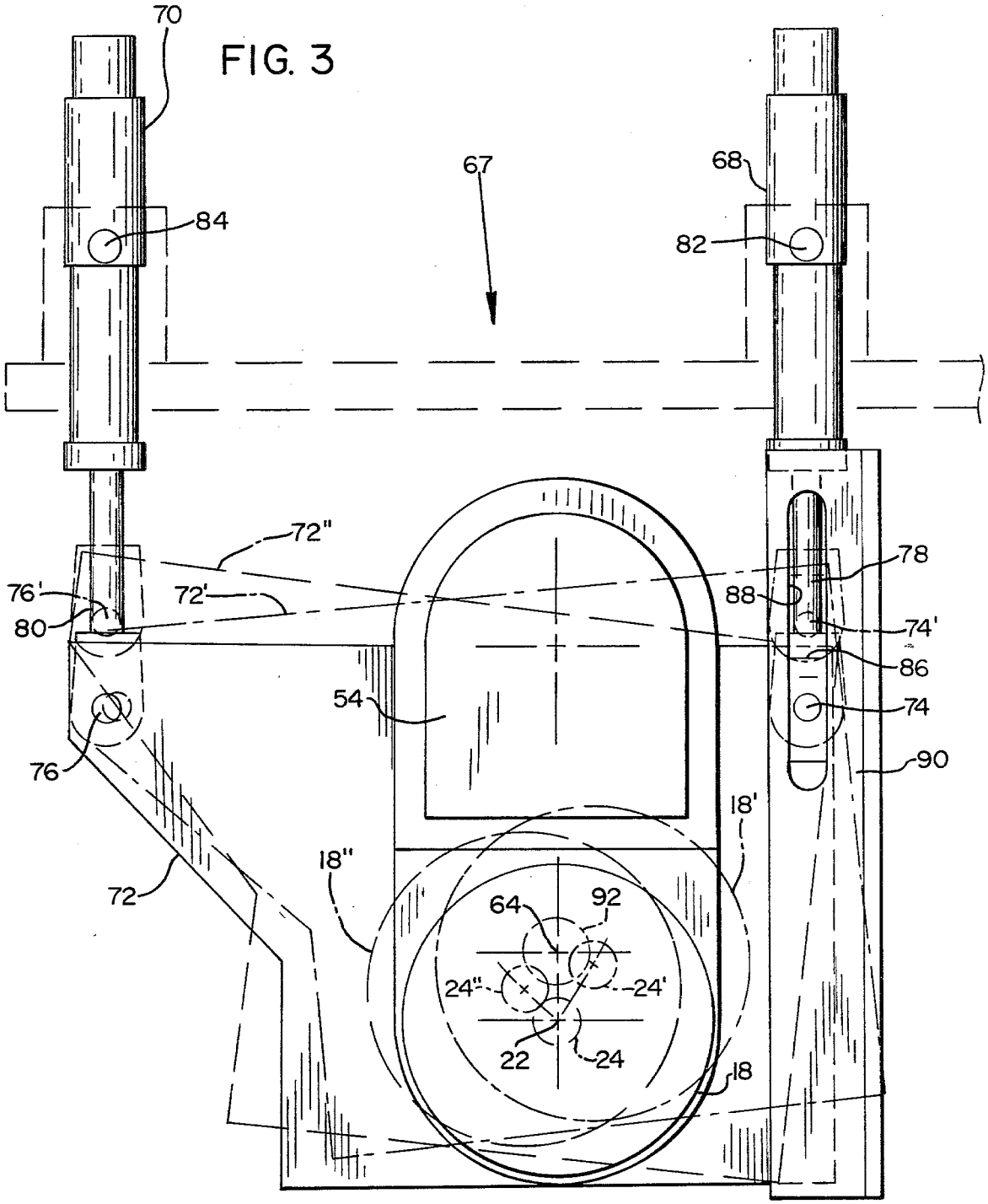
FIG. 3 is an enlarged view of a portion of the charger apparatus of FIG. 1 showing the charger spindle support and adjustment means in several different positions.
Figure 5:
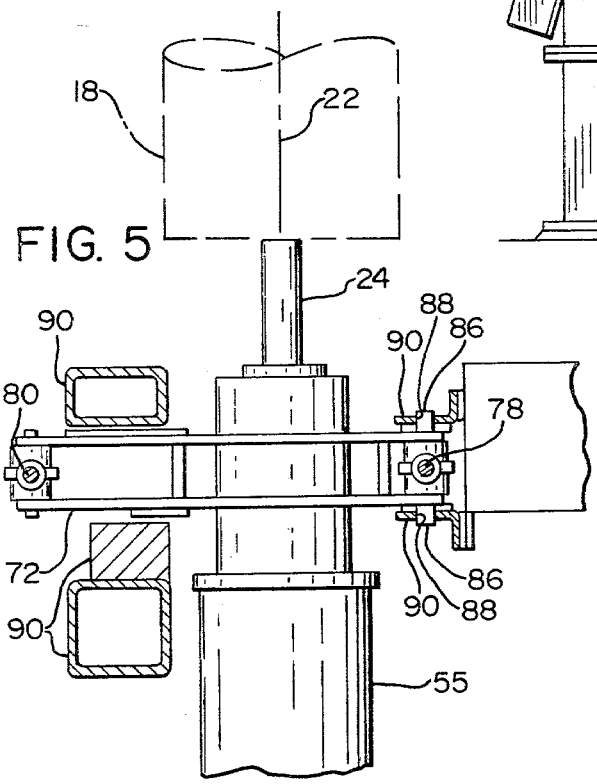
FIG. 5 is a horizontal section view taken along the line 5—5 of FIG. 2.

As shown in FIGS. 3 and 5, after the log 18 has been scanned in the scanning position 22 to determined the optimum yield axis of the log, such log is moved upward by a spindle support and adjustment mechanism 67 for each spindle 24 until such optimum yield axis coincides with the transfer position 64. This movement of the log from the scanning position 22 to the transfer position 64 is accomplished by a pair of linear positioners 68 and 70 which may be cylinders whose pistons are connected to a spindle support and adjustment member 72 that supports the spindle 24, motor 54, housing 55 and cylinder 56. The linear positioners 68 and 70 are mounted above the log in its transfer position and are connected by pivot connections 74 and 76 respectively at the ends of their piston rods to the spindle support and adjustment member 72. As a result of the substantially vertically linear movement of the piston rods 78 and 80, the spindle support and adjustment member 72 is raised and lowered and is also pivoted about the pivot connections 74 and 76 to provide both vertical and horizontal adjustment of the log until its optimum yield axis is aligned with the transfer position axis 64.

The horizontal and vertical adjustment of the spindle 24 is shown in FIG. 3 by one extreme left upper position 72' and one extreme right upper position 72" of the support plate. The linear positioners 68 and 70 are both pivotally mounted to the frame by trunions at pivot points 82 and 84, respectively. As shown by the position 72' of the spindle support and adjustment member in FIG. 3, when piston rod 80 does not move and the piston rod 78 is raised the log 18 and spindle 24 are moved vertically upward and horizontally to the left into the position of 18' and 24'. Similarly, when piston rod 78 does not move, but piston rod 80 is raised, the spindle support and adjust member is moved to position 72" by pivoting about pivot connection 74. This raises the log 18 and spindle 24 vertically upward and moves them horizontally to the right into the position 18" and 24". As a result, by moving the piston rods 78 and 80 different amounts but in the same vertical direction, the position of the log can be adjusted both vertically and horizontally until its maximum yield axis is in alignment with the transfer position axis 64.

The movements of linear positioners 68 and 70 are controlled by the electrical output signals of the computer which determines the optimum yield axis of the log from the information obtained during scanning. While many different types of linear positioners can be employed, one suitable positioner is the linear electro-hydraulic pulse drive Model LS-300 manufactured by Olsen Controls, Inc. of Bristol, Conn. This type of linear positioner uses an electric step motor to operate a valve which controls the flow of hydraulic fluid onto the opposite ends of the cylinder to control the position of the piston rod within such cylinder in a highly accurate manner. However, any suitable linear positioner can be employed including the jack screw type positioner disclosed in my earlier U.S. Pat. No. 4,197,888.

The pivot connection 74 of piston rod 78 is connected to a key member 86 which slides vertically in two keyway slots 88 provided in a pair of fixed frame members 90 as shown in FIG. 5. As a result, the pivot connection 74 can only be moved vertically in the path of such slot. As a result when both of the linear positioners 68 and 70 are energized the same amount to cause the piston rods 78 and 80 to move the same distance, the spindle support and adjust member 72 moves vertically upward without any horizontal movement. This condition exists when the optimum yield axis of the log happens by accident to correspond with the scan position axis 22. In this case the log is moved upward an exact predetermined amount of for example, four inches, until the optimum yield axis corresonds with the transfer position axis 64. However, this condition where the optimum yield axis corresponds to the scan position axis 22 very seldom happens so that it is usually necessary to move the log horizontally as well as vertically to align its optimum yield axis with the transfer position axis 64.

In the preferred embodiment of the present invention, the spindle support and adjustment means 67 of FIG. 3 can move the log through a radial distance of plus or minus 1.5 inches horizontally and vertically relative to the transfer position 64. As a result, the area of adjustment of the spindle around the transfer point 64 is the area of a circle having a radius of 1.5 inches as shown by the dashed circle 92.

Figure 6:
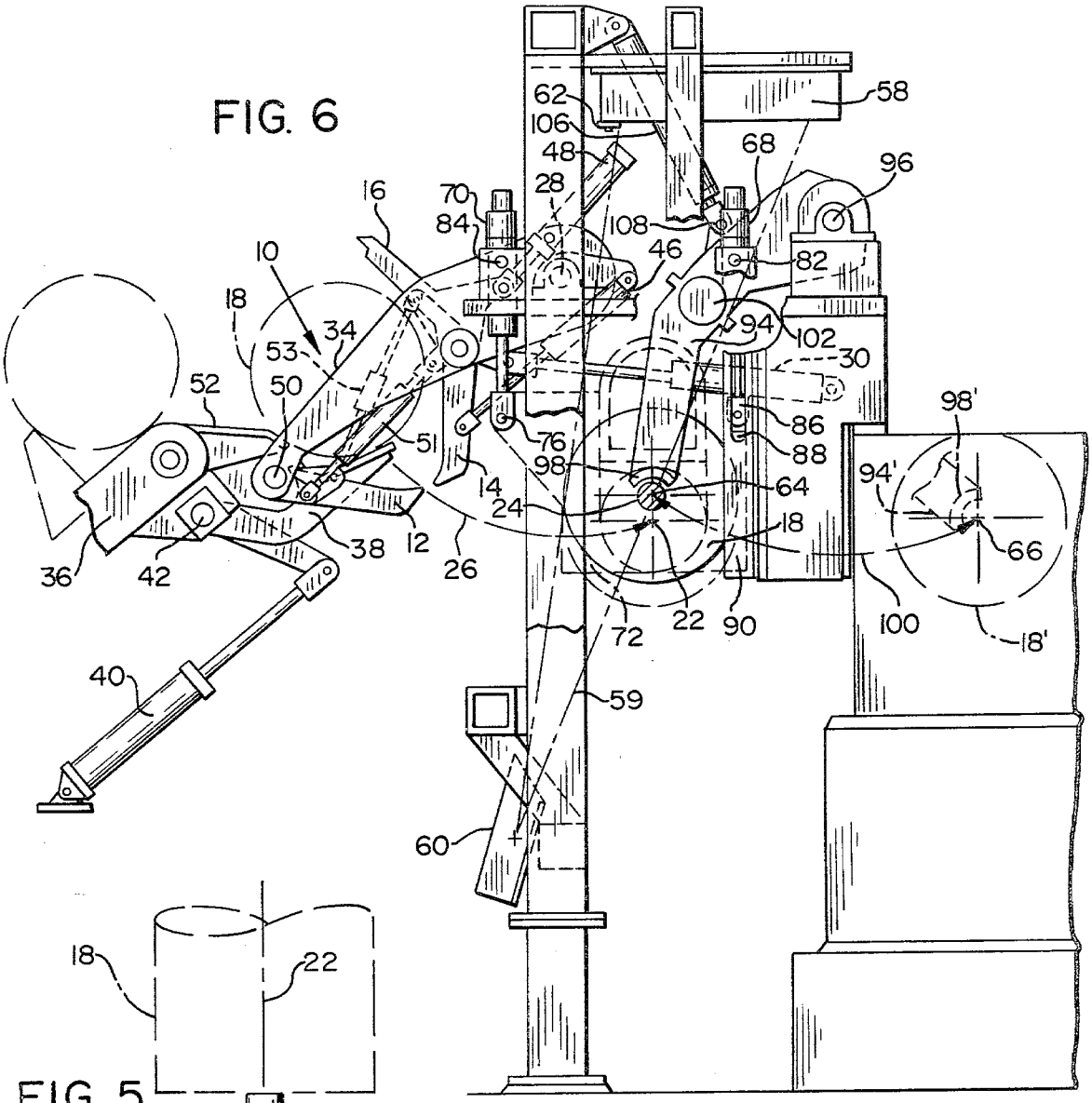
FIG. 6 is a partially diagrammetic view showing the positions of the log as it moves through the lathe charger apparatus of FIGS. 1 to 5.

The log is transferred from the transfer position axis 64 to the lathe spindle axis 66, as shown in FIG. 6. A pair of transfer arms 94 are moved into engagement with the opposite ends of the log by cylinders 104 shown in FIG. 2. Then the transfer arms 94 are caused by cylinders 106 to pivot about a support shaft 96. It should be noted that the transfer arm 96 swings back from a position adjacent the lathe axis 66 to the transfer position axis 64 while the charger spindles 24 are still in the scan position 22. This is possible because the scan position 22 is spaced below the transfer positions 64 by a sufficient distance to enable clearance between the arcuate end 98 of the transfer arm and the spindle 24. This swinging movement of the transfer arm is indicated by the double headed arrow 100 in FIGS. 1 and 6.

The log support and centering mechanism 10 is disengaged from the log prior to scanning and does not reclamp the log in the transfer position 64. This enables the log support and centering mechanism 10 to return to the pick-up position 20 where it receives another log while the first log is being scanned and transferred, thereby speeding up the lathe charger operation. Instead of reclamping, the log is supported only by the charger spindles 24 while it is moved from the scanning position 22 to the transfer position 64 and is engaged by the transfer arms 94. Thus the charger spindles disengage from the log only after the transfer arms 94 engage the opposite ends of the log at their arcuate ends 98.

In order to engage the log, the transfer arms 94 are caused to slide along a guide shaft 102 extending through the middle of such arms, by an actuator cylinder 104 in the manner described in my earlier U.S. Pat. No. 4,197,888. The transfer arm 94 is swung through arc 100 by an actuator cylinder 104 having one end pivoted to the frame and its piston rod connected at pivot connection 108 to a lever arm 110 attached to the support shaft 102. It should be noted that the entire transfer arm assembly including the transfer arm 92, guide shaft 102 and cylinder 104 is supported upon the upper support shaft 96 and pivots about such shaft in response to actuation by cylinder 106.

As shown in FIG. 6, after the log is swung by the transfer arms 94 from the transfer position to the lathe axis position 66, the lathe spindles engage the opposite ends of the log and rotate the log after the transfer arms are disengaged. As a result wood veneer is peeled by the lathe knife (not shown) and a maximum production yield of veneer is obtained from the log in question. However, its also possible that the log can be cut into boards by saws at work position 66 for maximum production yield of boards when the present invention is used for saw mill processing of the log rather than veneer lathe processing. This completes one complete cycle of operation of the lathe charger apparatus of the present invention.

It will be obvious to one having ordinary skill in the art that many changes may be made in the preferred embodiment of the invention without departing from the spirit of the invention. Therefore the scope of the present invention should be determined by the following claims.

What is claimed is:

1. Log processing apparatus, comprising:

log support and centering means for supporting and positioning a log with its axis roughly centered at a scan position;

charger spindle means for engaging the ends of the log after rough centering and rotating said log about a spindle axis at said scan position;

scanning means for scanning the log with a light beam at different rotational positions of said log to determine the optimum yield axis of the log for optimum production;

spindle support and adjustment means attached to linear positioning means for supporting and adjusting the position of the charger spindle means both vertically and horizontally in response to linear movement of said linear positioning means in one direction, to move the log and position its optimum axis at a transfer position which is located at a predetermined position relative to a work axis; and transfer means for engaging the log in said transfer position and for transferring the log from said transfer position to a work position where the log is cut after disengaging the charger spindle means so that the optimum axis of the log is aligned with the work axis.

2. Apparatus in accordance with claim 1 in which the linear positioning means is mounted above the log when said log is in said transfer position.

3. Apparatus in accordance with claim 1 in which the spindle support and adjustment means includes two spindle adjustment assemblies, one for each of a pair of charger spindles at the opposite ends of the log.

4. Apparatus in accordance with claim 3 in which each spindle adjustment assembly includes a spindle support member and two linear positioners pivotally connected to said spindle support member on opposite sides of the spindle so that the spindle support member moves vertically and horizontally in accordance with the amount of movement of said positioners.

5. Apparatus in accordance with claim 4 in which one of the linear positioners has its pivot connection attached to a key means which slides in a fixed keyway means to guide the movement of said pivot connection.

6. Apparatus in accordance with claim 4 in which the linear positioners each include a piston having a piston rod pivotally connected at one end to the spindle support member.

7. Veneer lathe charger apparatus in accordance with claim 1 in which the work axis is a lathe spindle axis and the work position is at the lathe.

8. Charger apparatus in accordance with claim 7 in which the log support and centering means receives the log at a pickup position and moves it to said scan position spaced a predetermined distance from said pickup position.

9. Charger apparatus in accordance with claim 8 in which the log support and centering means includes two sets of three clamp arms which engage the side of the log adjacent the opposite ends of log to clamp the log in a rough centered position.

10. Charger apparatus in accordance with claim 9 in which the transfer means engages the opposite ends of the log while said log support and centering means is disengaged from said log so that the log support and centering means can receive another log at said pickup position while the first mentioned log is being transferred from said transfer position to the lathe axis.

11. Apparatus in accordance with claim 1 in which the spindle support and adjust means moves the log to a transfer position which is spaced from said scan position by an amount sufficient to enable the transfer means to clear the charger spindle means in said scan position when said transfer means moves from the work position to said transfer position.

12. Veneer lathe charger apparatus, comprising:

log support and centering means for supporting and positioning a log with its axis roughly centered at a scan position;

charger spindle means for engaging the ends of the log after rough centering and rotating said log about a spindle axis at said scan position;

electronic scanning means for scanning the log at different rotational positions of the log to determine the optimum yield axis of the log for optimum wood veneer production;

spindle support and adjustment means for adjusting the position of the charger spindle means to move the log and position its optimum axis at a transfer position which is spaced from said scan position and is located at a predetermined position relative to a lathe spindle axis; and transfer means for engaging the opposite ends of the log in said transfer position while the charger spindle means is still engaged and for transferring the log from said transfer positon to the lathe spindle position after disengaging the charger spindle means;

said transfer position being spaced from said scan position by an amount sufficient to enable the transfer means to clear the charger spindle means in said scan position when said transfer means moves from the lathe spindle position to said transfer position.

13. Charger apparatus in accordance with claim 12 in which the log support and centering means receives the log at a pickup position spaced from the scan position and moves it to said scan position, and the transfer means engages the log after said support and centering means has disengaged from the log and moved back toward said pickup position.

14. Charger apparatus in accordance with claim 12 in which the spindle support and adjustment means is attached to linear positioning means and moves the log vertically and horizontally in response to linear movement of said linear positioning means in one direction in order to move the optimum axis of said log to the transfer position.

15. Log processing apparatus, comprising:

log support and centering means for supporting and positioning a log with its axis roughly centered at a scan position;

charger spindle means for engaging the ends of the log after rough centering and rotating said log about a spindle axis at said scan position;

scanning means for scanning the log during rotation by said charger spindle means, to determine the optimum yield axis of the log for optimum production;

spindle support and adjustment means attached to linear positioning means for supporting and adjusting the position of the charger spindle means both vertically and horizontally in response to linear movement of said linear positioning means in one direction, to move the log and position its optimum axis at a transfer position which is located at a predetermined position relative to a work axis; and transfer means for engaging the log in said transfer position and for transferring the log from said transfer position to a work position where the log is cut after disengaging the charger spindle means so that the optimum axis of the log is aligned with the work axis.

16. Veneer lathe charger apparatus, comprising:

log support and centering means for supporting and positioning a log with its axis roughly centered at a scan position;

charger spindle means for engaging the ends of the log after rough centering and rotating said log about a spindle axis at said scan position;

scanning means for scanning the log at different rotational positons of said log to determine the optimum yield axis of the log for optimum wood veneer production;

spindle support and adjustment means for adjusting the position of the charger spindle means to move the log and position its optimum axis at a transfer position which is spaced from said scan position and located at a predetermined position relative to a lathe spindle axis; and transfer means for engaging the opposite ends of the log in said transfer position and for transferring the log from said transfer position to the lathe spindle position after the charger spindle means disengages from the log;

said transfer position being spaced from said scan position by an amount sufficient to enable the transfer means to clear the charger spindle means in said scan position when said transfer means moves from the lathe spindle position to said transfer position.

* * * * *